United States Patent [19]

Wooldridge

[11] 4,332,597

[45] Jun. 1, 1982

[54] PLATE ELECTRODE ARRANGEMENT FOR AN ELECTROSTATIC PRECIPITATOR

[75] Inventor: James E. Wooldridge, Louisville, Ky.

[73] Assignee: Allis-Chalmers Corporation, Milwaukee, Wis.

[21] Appl. No.: 222,040

[22] Filed: Jan. 2, 1981

[51] Int. Cl.[3] ..... B03C 3/08; B03C 3/12

[52] U.S. Cl. ..... 55/124; 55/138; 55/143; 55/145; 55/139

[58] Field of Search ..... 55/118, 123, 124, 137, 55/138, 140, 141, 143, 145, 147, 139

[56] References Cited

U.S. PATENT DOCUMENTS

| | | | |
|---|---|---|---|
| 1,400,795 | 12/1921 | Bradley | 55/138 |
| 2,949,168 | 8/1960 | Peterson | 55/118 |
| 3,016,980 | 1/1962 | Gonzalez | 55/143 |
| 3,041,807 | 7/1962 | Getzin et al. | 55/143 |
| 3,862,826 | 1/1975 | Haupt | 55/118 |
| 4,240,811 | 12/1980 | Jacobsson | 55/138 |
| 4,259,093 | 3/1981 | Vlastos et al. | 55/137 |

FOREIGN PATENT DOCUMENTS

| | | | |
|---|---|---|---|
| 52-6178 | 1/1977 | Japan | 55/137 |
| 99669 | 1/1962 | Norway | 55/137 |

*Primary Examiner*—David L. Lacey
*Attorney, Agent, or Firm*—Thomas G. Anderson

[57] ABSTRACT

An electrode plate arrangement for an electrostatic precipitator including a plurality of essentially identical plate assemblies secured in an opposing fashion to the opposite sides of a grid-like mounting frame extending across the interior of the precipitator. The plate assemblies on the upstream side of the frame include an ionizing zone for the dirty gas stream which feeds into serially aligned collecting zones in the opposing assemblies which in turn feed into a deionizing zone in the plate assemblies on the downstream side of the frame.

7 Claims, 2 Drawing Figures

PLATE ELECTRODE ARRANGEMENT FOR AN ELECTROSTATIC PRECIPITATOR

BACKGROUND OF THE INVENTION

1. Field of Invention

This invention relates to electrostatic precipitators and in particular to an improved plate electrode arrangement for an electrostatic precipitator.

2. Background of the Invention

The prior art discloses a variety of electrostatic precipitators wherein one or more plate electrode assemblies are removably secured within the precipitator housing. For example, U.S. Pat. No. 3,016,980 discloses a relatively lightweight and easily fabricated plate electrode assembly which is easy to handle and install in the field. The plate electrode assembly shown in that patent is fairly typical of those currently in use in that it includes an ionizing zone having a plurality of wires forming upstream discharge electrodes and a plurality of ionizing and collecting plates alternately positioned in a collecting zone downstream from the ionizing zone. While experience has shown this type of arrangement to be relatively compact and easy to handle, its collecting efficiency is limited by the length or depth of the ionizing and collecting zones which it would require to obtain greater collecting efficiencies. Thus, if this type of arrangement were modified to obtain greater efficiencies than have generally been experienced, its weight and complexity would make it difficult for a workman to handle during routine servicing of the precipitator in the field as well as increasing the size and fabrication costs of the precipitator installation.

SUMMARY OF THE INVENTION

The present invention relates to an electrostatic precipitator for removing particulates from a dirty gas stream and in particular to an improved electrode plate arrangement for the precipitator.

The arrangement includes a plurality of essentially identical electrode plate assemblies secured in an opposing fashion to the opposite sides of a grid-like mounting frame within the precipitator to form two banks of plate assemblies extending across the interior of the precipitator housing. The plate assemblies on the upstream side of the mounting frame provide an initial ionizing zone for the gas stream which feeds into serially aligned collecting zones in the opposing assemblies which in turn feed into a deionizing zone in the plate assemblies on the downstream side of the mounting frame. Additionally, in order to accommodate the removal of water or liquid detergents injected into the precipitator housing during cleaning operations, a wire mesh screen is secured across the gas stream flow path downstream from the deionizing zone. Preferably, this screen is secured in a frame or the like mounted on each plate assembly on the downstream side of the mounting frame.

From the foregoing, it can be seen that the electrode plate arrangement embodying the invention is of a relatively lightweight and durable design which is easy to assemble and service in the field. However, it is to be understood that various changes can be made in the arrangement, form and construction of the apparatus disclosed herein without departing from the spirit and scope of the invention.

DESCRIPTION OF THE PREFERRED EMBODIMENT

Figure 1:
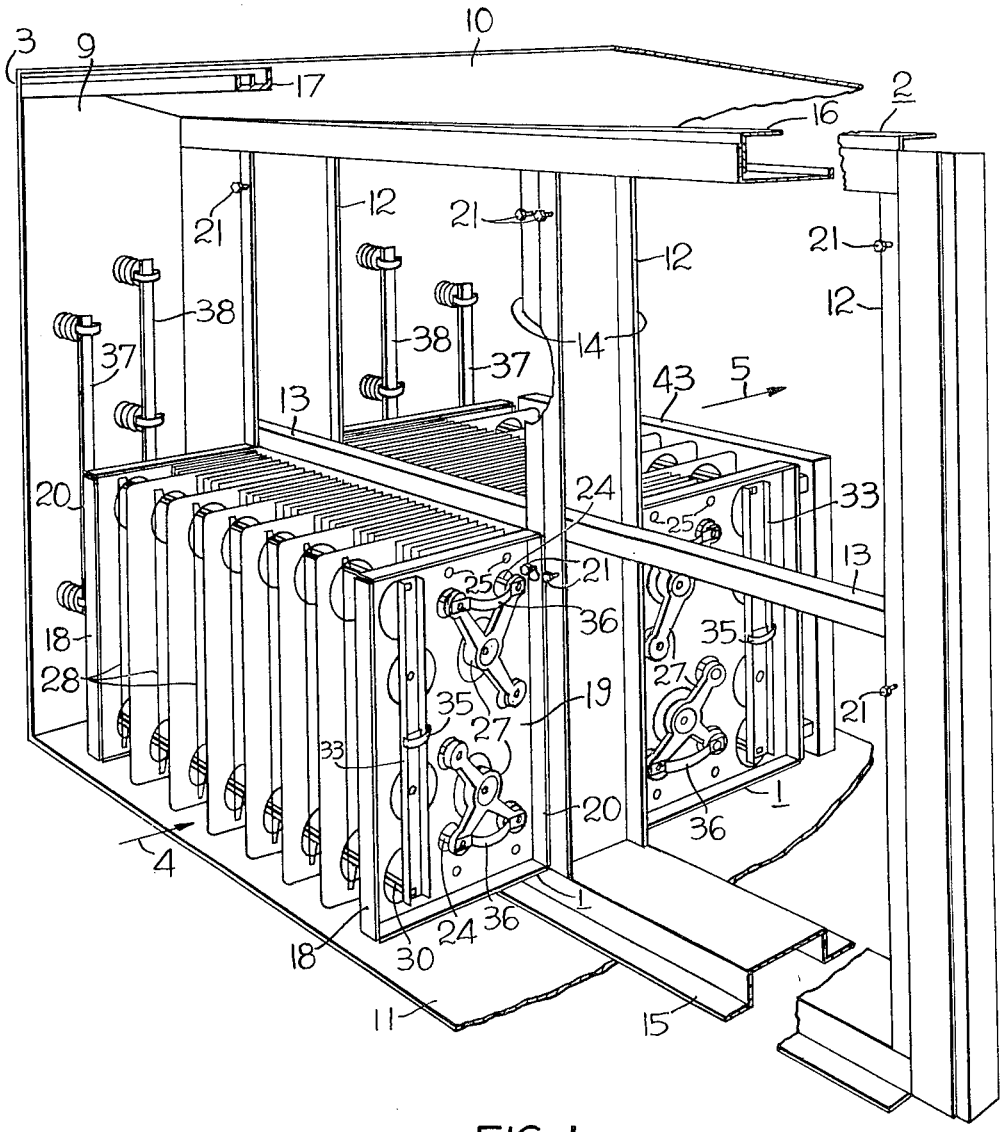
FIG. 1 is a partial perspective view of an electrostatic precipitator showing the electrode plate arrangements embodying the invention installed in the precipitator.

Referring to the drawings, there is shown a pair of opposing electrode plate assemblies or units 1 secured to a grid-like mounting frame 2 secured across the housing 3 of an electrostatic precipitator having a gas inlet and a gas outlet for directing a gas stream through the precipitator as indicated at 4 and 5, respectively. As will be described, this arrangement provides an ionizing zone 6, a pair of collecting zones 7, and a deionizing zone 8 for the gas stream as it flows between the plates of the assemblies during precipitating operations.

The housing 3 includes spaced and facing side walls 9, a top wall 10, and a bottom wall 11 to which the mounting frame 2 is secured by bolts or other suitable means. The grid-like mounting frame 2, which can be of a welded or bolted construction, includes a plurality of spaced channel-shaped beams 12 extending vertically within the housing 3 which are interconnected by baffle sections 13 to define a plurality of openings 14 in the frame. The lower ends of the vertical beams 12 are affixed to a hat-shaped channel section 15 secured across the bottom of the housing 3 and the upper ends of the vertical beams 12 are affixed to an upper channel section 16 secured across the top of the housing. Additionally, a rail member 17 is secured between the facing side walls 9 on what serves as the upstream side of the housing during precipitating operations. The rail members 17 are preferably U-shaped channel sections which are adapted to accommodate any one of a number of known types of carriage mechanisms for a washing device for spraying water or detergent into the plate assemblies. Since the particular type of washing device to be used does not constitute an essential part of the invention, it is not shown in the drawings.

Each of the opposing electrode plate assemblies 1 is similar to that shown in U.S. Pat. No. 3,016,980 which is incorporated by reference in this application. As shown in the drawings, each pair of the opposing plate electrode assemblies 1 includes spaced end plates 18 defining a pair of collecting zones 7, an ionizing zone 6 and a deionizing zone 8. Each of the end plate members 18 is of a rectangular configuration including a vertical panel portion 19 and a border or flange 20 extending at right angles of the panel portion. As will be described, the borders 20 serve to shield the several parts of the assembly immediately adjacent the outside faces of the panel portion 19 from the gas stream and also provide attaching surfaces for securing the assembly to the grid-like mounting frame. In the embodiment shown in the drawings, each of the plate assemblies are suspended on the pins 21 as described in detail in the applicant's copending patent application entitled "Mounting Arrangement for Electrostatic Precipitator", Ser. No. 222,039, and having the same filing date as this application. Alternatively, each of the plate assemblies can be supported on the frame by a pair of tracks or brackets cantilevered from the vertical support members such as provided in the mounting arrangement shown in U.S. Pat. No. 3,041,807.

Figure 2:
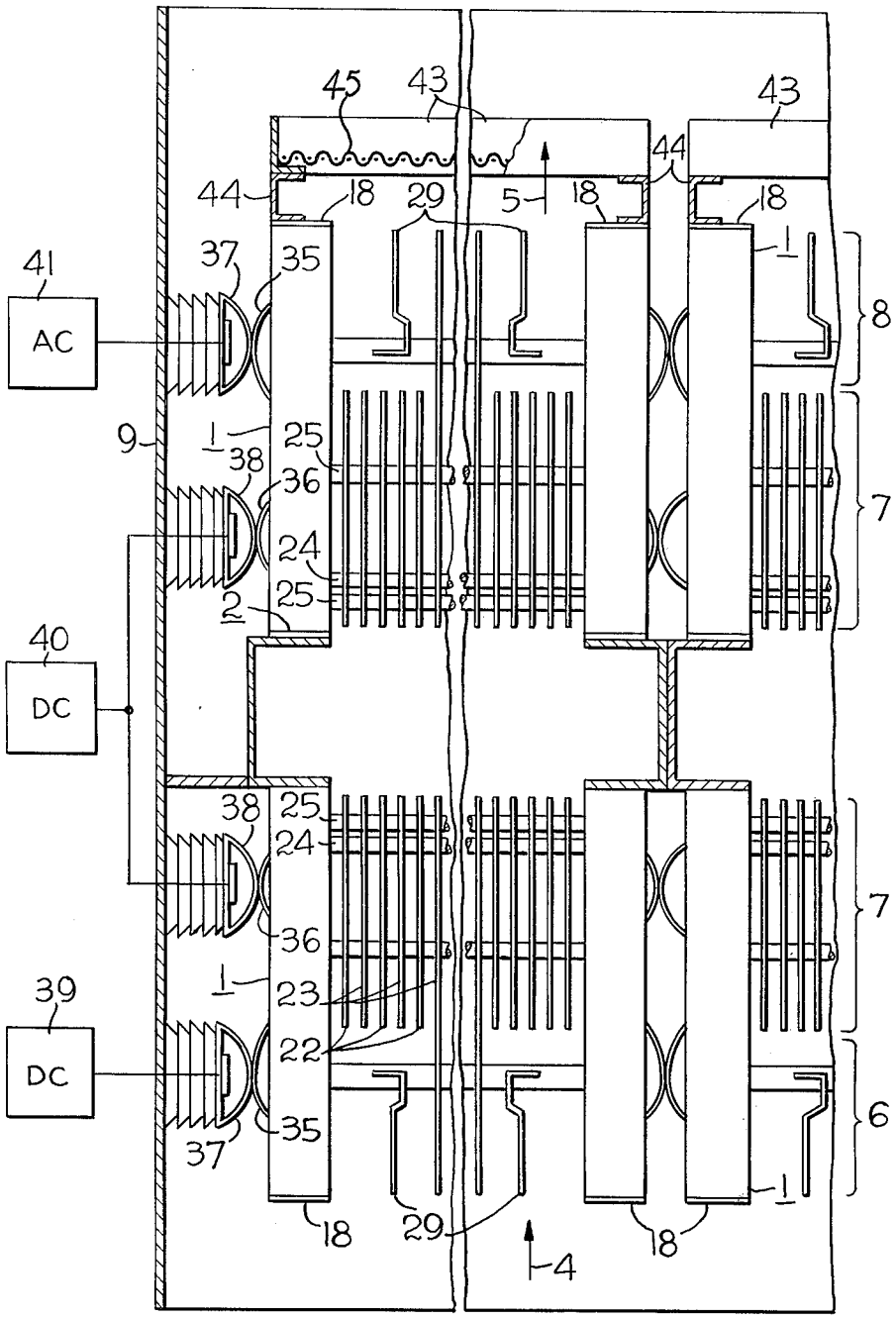
FIG. 2 is a plan view of the electrode plate arrangement shown in FIG. 1.

Referring to FIG. 2, a set of spaced charged plates 22 and a pair of spaced grounded plates 23 are alternately disposed in spaced parallel relation in the collecting zones 7 between the end plates 18. These sets of plates 22 and 23 are spaced from each other and supported from the end members 18 by spacer beams 24 and 25, respectively. Each charged plate 22 is provided with a pair of clearance apertures or cutaways (not shown) at the top and bottom of the plate and at its midpoint which provide sufficient clearance for electrically insulating the spacer bars 25 secured to the end plates 18 to space and support the grounded plates in the assembly. The grounded plates 23 are similarly provided with insulating clearance apertures for the spacer bars 24 which space and support the charged plates in the assembly. In this regard, it should be noted that the spacer bars 24 are arranged in the assembly so that their opposite ends pass through clearance apertures or cutaways in the panel portions 19 such that the ends of the spacer bars 24 are electrically insulated from the end plate members 18 while being supported by the spider-shaped bus bars 27 mounted on the end plate members.

As shown in the drawings, a selected number of the grounded plates 23 extend into the ionizing zone 6 and the deionizing zone 8. The portions of the grounded plates 23 which extend into the ionizing and deionizing zones 6 and 8 serve as collector plates for those zones, cooperating with the spaced discharge electrodes or ionizing wires 28 aligned between the grounded plates. Each of the ionizing wires 28 is supported by a pair of pins 29 which are cantilevered from a pair of supporting bars 30 extending through the precipitator. As in the case of the charged plate spacer bars 24, the supporting bars 30 extend through a series of enlarged apertures in the grounded plates and similarly enlarged apertures in the panel portions 19 where they are supported by the bus bars 33 which are secured to the panel portions by electrical insulators.

Although for purposes of illustration, only one pair of opposing electrode plate assemblies 1 is shown in the drawings, it is to be understood that a pair of plate assemblies is to be secured over each of the frame openings 14 to form horizontal rows of side-by-side plate assemblies. When the plate assemblies 1 are installed on the mounting frame 2, the electrical contacts 35 and 36 on each of the plate assemblies mate or abut identical contacts on the plate assemblies adjacent to it, it being noted that the contacts 35 and 36 on the outer pair of plate assemblies shown on the left side of FIG. 1 mate or abut the electrical contacts 37 and 38, respectively.

During normal operation of the precipitator, a potential of about 14,000 volts is maintained between the discharge electrodes 28 in the ionizing zone on the upstream side of the mounting frame and the grounded collecting plates 23. This is maintained by a first DC power source 39 connected to the discharge electrodes 28 through the electrical contacts 35 and 37 on the upstream side of the mounting frame. At the same time, a potential of about 6,000 volts is maintained between the charged plates 22 in the collecting zones of the two assemblies and the ground by a second DC power source 40 connected to the plates 22 through the electrical contacts 36 and 38. This arrangement accommodates the initial ionization and subsequent removal of the particulates from the gas stream as it flows through the ionizing and collecting zones of the assemblies. As the gas stream leaves the collecting zones it passes into the deionizing zone where the residual charges on any of the charged particles which have gotten by the collecting plates are neutralized. This is accomplished by maintaining an AC potential of about 8,000 volts between the discharge electrodes or wires 28 in the deionizing zone and the ground. This potential difference is maintained by an AC power source 41 connected to the discharge electrodes 28 in the assembly on the downstream side of the mounting frame through its respective electrical contacts 35 and 37. Finally, as the gas stream leaves the deionizing zone, it flows through a wire mesh 45 which is secured to a rectangular frame 43 mounted on the downstream plate assembly by suitable brackets 44 as shown in the drawings. This structure serves to remove or eliminate most of any remaining water or detergent injected into the housing during cleaning operations before the gas stream flows out of the precipitator through the outlet as indicated at 5.

From the foregoing, it can be seen that the invention contemplates an arrangement wherein the upstream and downstream precipitating units are essentially interchangeable so as to provide a relatively lightweight and compact arrangement which is easy to service and maintain in the field. In practice, experience has shown that the cleaning efficiency of this type of arrangement is in the range of 6–10 times the efficiency of a single bank of the precipitating units. For example, in a precipitator utilizing a single bank of precipitating units to obtain a cleaning efficiency of 90 percent, the efficiency of the present arrangement would be in the range of 95–99 percent. Thus, in addition to providing a relatively lightweight and easily handled unit, the invention contemplates significantly improving the efficiency of the precipitator.

The embodiments of the invention in which an exclusive property or privilege is claimed are defined as follows:

1. In an electrical precipitator having a housing including an upstream gas inlet and downstream gas outlet for removing particulate materials from a gas stream flowing through the housing, the improvement comprising:

mounting frame means secured across the housing between the inlet and outlet, said frame means including a pair of spaced support beams spanning the interior of the housing between the inlet and outlet to form an opening for the gas stream flowing through the housing;

first and second interchangeable essentially identical electrode plate assemblies;

each of said plate assemblies including a discharge zone and a collector zone, a plurality of spaced discharge plates disposed in the collector zone, a set of collecting plates alternately arranged with said spaced plates in the collector zone and having portions extending into the discharge zone, spaced discharge electrode members alternately disposed in the discharge zone with those portions of the collecting plates extending into the discharge zone, and means supporting the discharge plates, collecting plates and electrode members in electrically insulated relationship with one another;

said plate assemblies being supported in registry with said opening by said beams, said first plate assembly being supported on the one side of said beams and said second plate assembly being supported in an opposing fashion on the other side of said beams whereby the discharge zone of said first plate assembly is on the one side of the plate assemblies and the discharge zone of said second plate assembly is on the other side of the plate assemblies;

and means for energizing said plate assemblies including a first DC source connected to the discharge electrode members of said first plate assembly, a second DC source connected to the discharge plates of both of said first and second plate assemblies, and an AC source connected to the discharge electrode members of said second plate assembly.

2. The precipitator according to claim 1, and said mounting frame means having a plurality of said spaced support beams supporting a corresponding plurality of said first and second plate assemblies in adjacent side-by-side relationship on their respective sides of beams.

3. The precipitator according to claim 1, and fastening means suspending said first and second plate assemblies from said support beams.

4. The precipitator according to claim 1, and said first and second plate assemblies being supported on a plurality of track members cantilevered from the one and other sides of said beam members.

5. The precipitator according to claim 1, and further including liquid eliminator means disposed between said second plate assembly and said gas outlet.

6. The precipitator according to claim 8, and said liquid eliminator being affixed to said second plate assembly beyond the ionizer discharge zone of said second assembly.

7. The precipitator according to claim 8, and said liquid eliminator means including a frame member having a gas aperture and a wire mesh secured to the frame across the aperture.

* * * * *

UNITED STATES PATENT OFFICE

CERTIFICATE OF CORRECTION

Patent No. 4,332,597 Dated June 1, 1982

Inventor(s) James E. Wooldridge

It is certified that error appears in the above-identified patent and that said Letters Patent are hereby corrected as shown below:

Column 6, line 11, claim "8" should read claim --- 5 ---;

Column 6, line 15, claim "8" should read claim --- 5 ---.

Signed and Sealed this

*Seventeenth* Day of *August 1982*

[SEAL]

*Attest:*

GERALD J. MOSSINGHOFF

*Attesting Officer* *Commissioner of Patents and Trademarks*